US006309184B1

(12) United States Patent
Moraja et al.

(10) Patent No.: US 6,309,184 B1
(45) Date of Patent: Oct. 30, 2001

(54) TEMPERATURE-RESPONSIVE MOBILE SHIELDING DEVICE BETWEEN A GETTER PUMP AND A TURBO PUMP MUTUALLY CONNECTED IN LINE

(75) Inventors: Marco Moraja, Milan; Luca Viale, Bollate, both of (IT)

(73) Assignee: SAES Getters S.p.A., Lainate (IT)

( * ) Notice: Subject to any disclaimer, the term of this patent is extended or adjusted under 35 U.S.C. 154(b) by 0 days.

(21) Appl. No.: 09/578,650

(22) Filed: May 25, 2000

Related U.S. Application Data

(63) Continuation of application No. PCT/IT99/00332, filed on Oct. 19, 1999.

(30) Foreign Application Priority Data

Oct. 19, 1998 (IT) ..... MI98A2235

(51) Int. Cl.[7] ..... F04B 37/02; F04B 23/08; B01D 8/00

(52) U.S. Cl. ..... 417/51; 417/199.1; 417/205; 62/55.5

(58) Field of Search ..... 417/51, 205, 199.1, 417/48, 901; 62/55.5

(56) References Cited

U.S. PATENT DOCUMENTS

| | | | | |
|---|---|---|---|---|
| 4,198,829 | | 4/1980 | Carle | 62/55.5 |
| 4,295,338 | * | 10/1981 | Welch | 62/55.5 |
| 4,475,349 | | 10/1984 | Batzer et al. | 62/55.5 |
| 4,791,791 | * | 12/1988 | Flegal et al. | 62/55.5 |
| 4,803,845 | * | 2/1989 | Strasser et al. | 62/55.5 |
| 5,056,319 | * | 10/1991 | Strasser | 62/55.5 |
| 5,114,316 | * | 5/1992 | Shimizu | 417/53 |
| 5,389,888 | | 2/1995 | Urano et al. | 315/503 |

FOREIGN PATENT DOCUMENTS

| | | | |
|---|---|---|---|
| 59 077178 | | 5/1984 | (JP) . |
| 59 080583 | | 10/1984 | (JP) . |
| 6191440 | * | 5/1986 | (JP) ..... F24F/11/02 |

* cited by examiner

*Primary Examiner*—Charles G. Freay
*Assistant Examiner*—Timothy P. Solak
(74) *Attorney, Agent, or Firm*—Akin, Gump, Strauss, Hauer & Feld, L.L.P.

(57) ABSTRACT

A temperature-responsive, mobile shielding device (10) is located between a getter pump (GP) and a turbo pump (TMP) being in line to each other, capable of providing a complete shielding to the radiating heat transfer from the getter pump to the turbo pump when the non-evaporable getter material is heated to be activated, while on the contrary leaving free, without sensible reductions of conductance the transfer during the normal working of the pumps. This is obtained by providing, mounted on a vacuum flange (13) coupling the two pumps, a set of shielding metal members (11, 31) including shape-memory elements, preferably of Ni—Ti alloy, capable of assuming two different configurations in a first of which, at a higher temperature, the shielding members (11, 31) are substantially all co-planar, with their edges slightly overlapping to form a complete shielding, while in a second configuration, at a lower temperature, the shielding members leave substantially free the passage between the two pumps.

18 Claims, 3 Drawing Sheets

TEMPERATURE-RESPONSIVE MOBILE SHIELDING DEVICE BETWEEN A GETTER PUMP AND A TURBO PUMP MUTUALLY CONNECTED IN LINE

CROSS-REFERENCE TO RELATED APPLICATION

This application is a continuation of International Application PCT/IT99/00332 filed Oct. 19, 1999 the disclosure of which is incorporated herein by reference.

BACKGROUND OF THE INVENTION

The present invention relates to a temperature-responsive, mobile shielding device between a getter pump and a turbo pump in an in-line arrangement, adapted for high vacuum systems.

It is known that the operation of the getter pumps is based on the chemical sorption of reactive gaseous species such as $O_2$, $H_2$, water and carbon oxides by means of systems made with non-evaporable getter materials (known in the art as NEG), generally in combination with other pumps for producing and maintaining high vacuum in an enclosed chamber. While the first step of high-pressure pumping is usually carried out by means of mechanical pumps (e.g. rotary pumps), high levels of vacuum can be obtained by means of getter pumps in combination with chemical-ion, cryogenic or turbo pumps. It is particularly advantageous the combination getter pump/turbo pump, showing a combination of different behaviours with respect to the atmospheric gases or anyhow gases to be eliminated; in particular, the getter pump used at room temperature has a very good sorption capacity for hydrogen which is the most difficult gas to be eliminated by the turbo pump. Such a combination is particularly useful when it is a matter of evacuating a working chamber used for high-vacuum operations, such as a particle accelerator or a chamber of a processing machine in the semiconductor industry.

It is also known that these advantages could reach the highest level by mounting the two pumps in series to each other, with the getter pump upstream of the turbo pump and co-axial therewith. However such an arrangement has resulted in some drawbacks, the most important of which derives from the fact that the non-evaporable getter material has to be activated at temperatures of about 500–600° C., by means of radiation heating from the inside or by flowing of electric current in the getter elements; furthermore, in certain applications the getter material is maintained at temperatures of about 200–300° C. (whereas, when the purpose is to have the highest sorption of hydrogen, as stated above, the getter material is caused to work at room temperature). The getter pump heating has the consequence of an indirect heating (mainly due to radiation) also of the turbo pump. This caused the blades of the latter to expand beyond the admissible tolerances (however negligible) for a good operation of the pump itself. In order to avoid this inconvenience, there was the possibility of increasing the distance between the two pumps, introducing stationary thermal shields between them or connecting said pumps to each other in a non co-axial manner, through an elbow-shaped element: however all these solutions resulted in an undesired reduction of the gas flow conductance, whereby the two pumps were generally mounted, by means of flanges, to two difference openings of the chamber to be evacuated, thus doing without the advantages consequent to arranging the two pumps directly in line and co-axially to each other.

With WO 98/58173 in the name of the same applicant, an attempt was made to overcome the inconveniences above by means of a getter pump being mounted upstream and in the proximity of a turbo pump, co-axial thereto and having such a structure to minimize the direct heating of turbo pump, at the same time reducing the possible loss of particles from the NEG pump, with a very small reduction of conductance. However the pump structure, formed of an elongated metal element as a zigzag-shaped wire, with porous non-evaporable getter material deposited by sintering thereon and having such a configuration to occupy a crown-shaped peripheral zone of a cylindrical cartridge being the support of the getter pump, has required a special getter pump to be expressly manufactured when it was expected its combined use with a turbo pump, thus being excluded the use of NEG pumps of normal production, which are less expensive and probably more efficient, but not designed for the specific use of working in combination with turbo pumps.

SUMMARY OF THE INVENTION

Therefore it is an object of the present invention to provide a mobile shielding device to be interposed between getter pump and turbo pump in high-vacuum systems, capable of rendering possible the in line connection between the two pumps without the above-mentioned inconveniences.

Another object of the present invention is that of providing a mobile shielding device between NEG pump and turbo pump, arranged in-line, which is capable of automatically passing from a complete shielding configuration to a configuration that leaves substantially free the cross-section area of passage between the two pumps, with the highest conductance, as a function of the temperature resulting from the radiation from the getter pump towards the turbo pump.

A further object of the present invention is that of providing a shielding device of the mentioned type, with which it is possible to use, in direct coupling with a turbo pump, a NEG pump of whichever commercial type, not necessarily designed for this purpose.

These objects are achieved with a mobile shielding device mounted on a connecting flange between NEG pump and turbo pump and comprising a plurality of shielding metal members capable of automatically changing their shape or orientation according to the temperature of the device itself, between two different configurations, in a first of which the shielding members are substantially coplanar and form a substantially continuous shield between NEG pump and turbo pump, while in the second configuration said members provide the lowest possible hindrance in the cross-section area of passage between the two pumps, thus ensuring the highest conductance, said shielding members comprising elements of a material provided with a shape memory, of known type, which are responsive to the temperature for passing from a first shape, corresponding to a higher temperature within a range of working temperatures of the shape-memory material, associated with the said first configuration of the shielding members, to a second shape corresponding to a lower temperature in the same range of temperatures, being associated with the said second configuration of the shielding members.

These and other objects, advantages and characteristics of the shielding device according to the present invention will appear more clearly from the following detailed description of some preferred embodiments thereof, given by way of non-limiting example with reference to the annexed drawings in which:

DETAILED DESCRIPTION OF THE INVENTION

Figure 1:
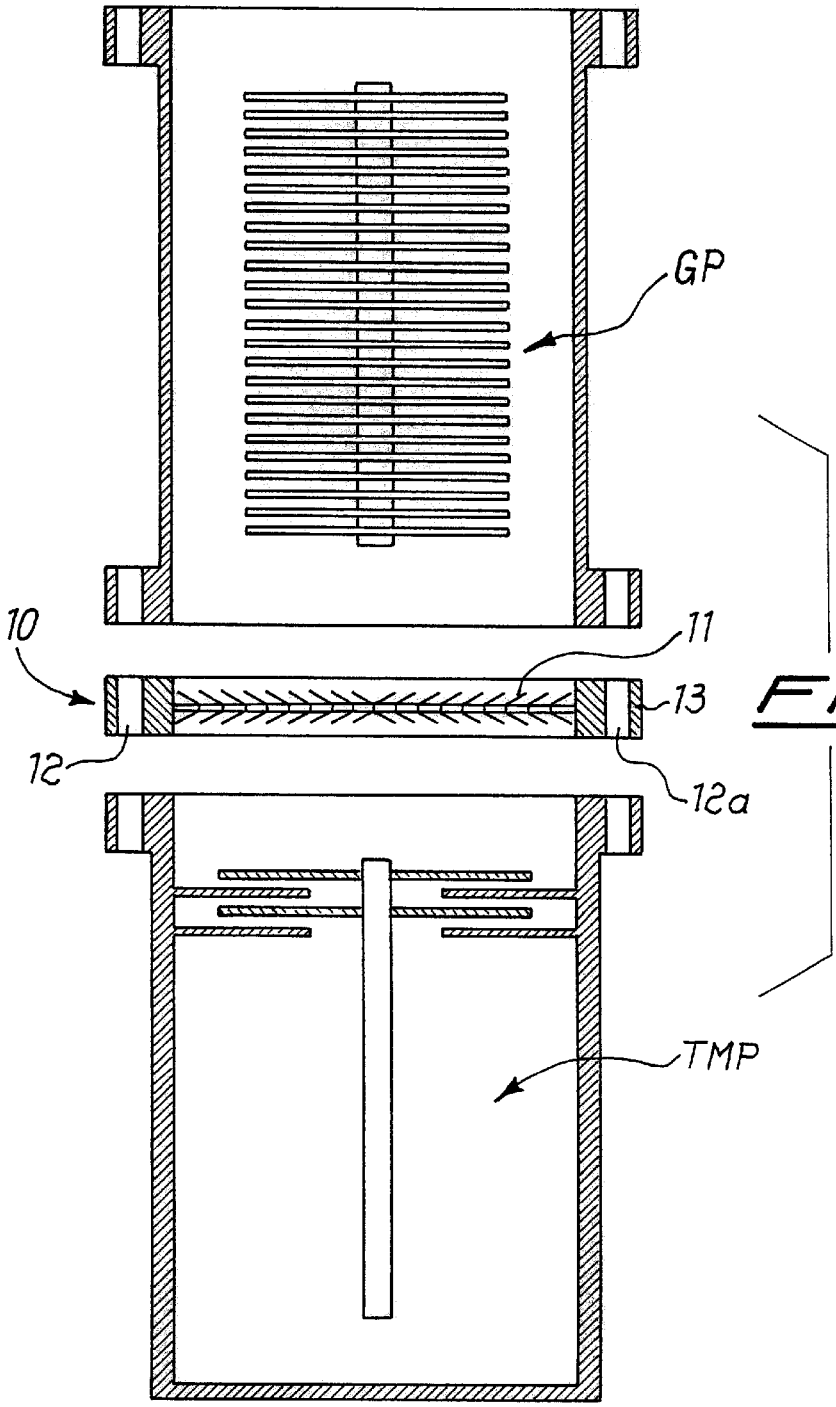
FIG. 1 is a schematic view in longitudinal cross-section with portions taken apart of a unit formed of a getter pump (NEG) and a turbo pump, with a mobile shielding device according to the present invention interposed therebetween, in a situation of closure.

The shields of the invention are formed of members entirely or partially made of materials provided with shape memory. These materials are already known in different applications and have the characteristic that objects made therewith can switch, in a very short time and without intermediate positions of equilibrium, from a shape to another, both pre-defined and set during their manufacture, in consequence of a change of temperature. The shields of the invention are such that when become heated, essentially by radiation, when the getter pump is heated at temperatures of up to 500–600° C. they take the "closed" shape, whereby the optical path between the getter pump and the turbo pump is obstructed, thus protecting the latter from heating; when the getter pump is cold, the shields of the invention cool down in turn and assume the "open" shape, wherein the members forming the shields offer the least surface possible in the direction of optical path between the two pumps, thus ensuring the highest conductance of gas towards the turbo pump.

The shape-memory materials comprise a first class of materials wherein the transition between a first and a second pre-defined shape occurs due to a temperature variation, while the opposite modification, between the second and the first shape, requires an external intervention with application of a mechanical force. Useful for the purposes of the present invention are the materials belonging to a second class, showing the so-called "two-way shape memory" mechanism, wherein both the direct and the inverse transformation occur by temperature variation. It is believed that these materials modify their microcrystalline structure by passing from a martensitic type, stable at lower temperatures, to an austenitic type, stable at higher temperatures and vice-versa. The transition between the two structures takes place according to a cycle, similar to a hysteresis cycle, being characterized by four levels of temperature: during the heating, starting from a low temperature in which the martensitic phase is stable, a temperature $A_s$ is reached at which the transformation into the austenitic phase begins, and then a temperature $A_f$ corresponding to the completion of the conversion into austenite; when cooling down, starting from the temperature range in which the austenitic phase is stable, a temperature $M_s$ is firstly reached, at which the transition into the martenisitic phase begins, and then a temperature $M_f$ at which such a transition comes to an end. The actual temperatures of the above-mentioned transitions are variable with the type of material and the process with which it is manufactured, but for every material these temperatures are always in the order $M_f<M_s<A_s<A_f$. For the purposes of the invention the most important parameters in estimating the two-way shape-memory materials are the temperatures $M_f$ and $A_f$. Since the turbo pumps can operate until the temperature of the moving parts does not exceed values of about 120° C., the shape-memory material used will have a value of $A_f$ not exceeding this temperature, and preferably not higher than about 100° C., so that the transition, with consequent change of configuration and closure of the shield, is complete when the temperature reaches values which would be critical for the turbo pump. The temperature $M_f$, at which the thermal shield is completely open, could be whichever, but is preferably higher than the room temperature; this allows to obtain the opening of the shield by merely natural cooling of the shield itself as a consequence of the getter pump cooling, without having to resort to appropriate cooling means. Materials having transition temperatures useful for the purposes of the invention are mainly the Ni—Ti alloys, in particular with Ni comprised between 54 and 56% by weight, the balance being titanium. Particularly preferred are the alloys of the composition Ni 55.1÷55.5%, balance titanium. These alloys show for $A_f$ values comprised between about 90 and 115° C. and for $M_f$ values between about 50 and 80° C. Ternary alloys of copper can also be used, such as Cu—Al—Ni alloys, or preferably Cu—Al—Zn alloys containing, by weight, between about 70 and 77% of copper, between about 5 and 8% of aluminum and between about 15 and 25% of zinc.

With reference to FIG. 1, there is shown a preferred embodiment of a thermoshielding device 10 being assembled, with a non-evaporable getter pump GP and a turbo pump TMP to form an assembly for the production and maintenance of high vacuum in a chamber, for example of a processing machine in the semiconductor industry. While the shielding members 11 will be better described in the following, the high-vacuum flange 13 is visible on which they are mounted. Flange 13 is provided with peripheral through holes 12, 12*a* for its fastening by suitable means (not shown) in corresponding peripheral holes formed at the adjoining ends of the two pumps. GP pump is also provided with another set of through holes at the opposite end for its fixing to the chamber to be evacuated.

Flange 13 is of the standard, double sealing vacuum type, in special steel, generally used with vacuum gaskets of copper. It is noted that the getter pump shown in the drawing is of the type comprising a stack of discs of non-evaporable getter material on a central support, but as already stated above, it could be of any other type, there being no limitations at all to the use in line with a turbo pump when an intermediate shielding device 10 is adopted according to the present invention.

It should be noted that in FIG. 1 the shielding members 11 have been schematically represented as having a V-shape in a closure condition, such as to obstruct whichever optical path between GP and TMP pumps, thus blocking at the same way any thermal flux between the two pumps and in particular from the getter pump towards the turbo pump.

Figure 1A:
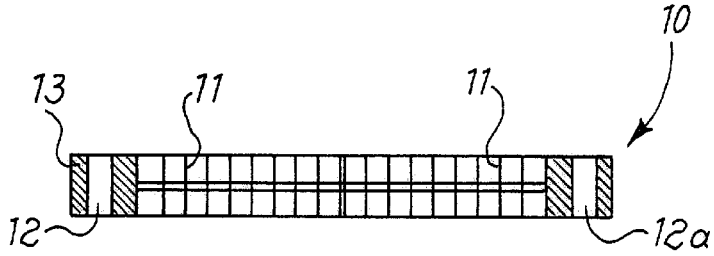
FIG. 1*a* is a cross-section view like in FIG. 1 of the shielding device alone, in an open condition.

The same device 10 according to the present invention has been instead represented in FIG. 1*a,* still schematically, with the members 11 not in the V-shaped configuration in cross-section, thus forming a herring-bone-pattern for the thermal insulation between the two pumps GP and TMP, but instead in an open configuration, all parallel to each other, thus offering the lowest hindrance possible, merely given by their reduced thickness, in the passage cross-section corresponding to the inner area of the flange 13.

Figure 2A:
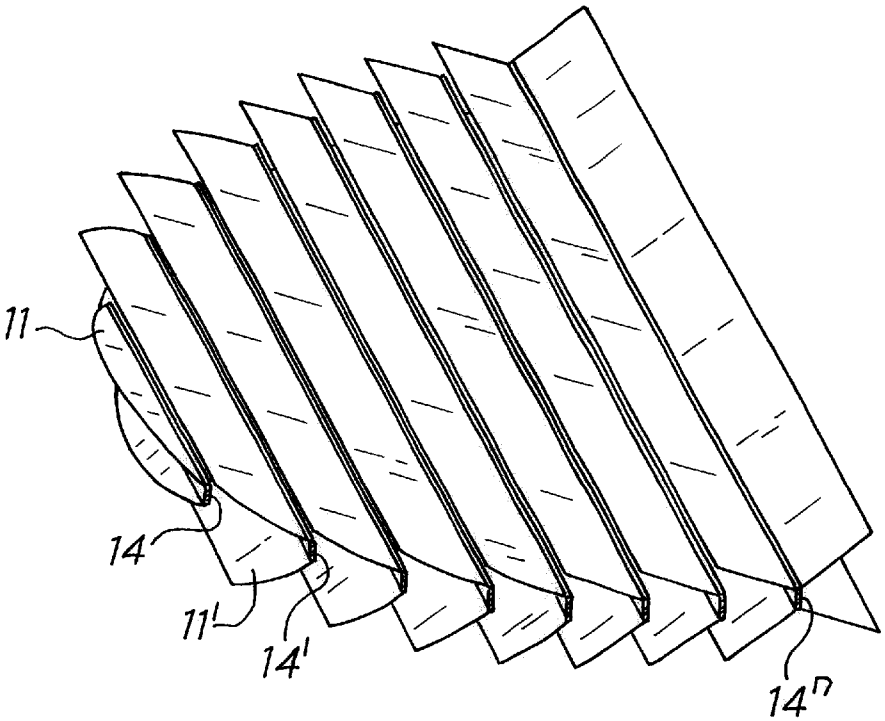
FIGS. 2 and 2*a* show, in a partial perspective view, some shielding, members of the device according to the present invention in the same embodiment of FIGS. 1 and 1*a,* respectively in the open and closed position.
Figure 2:
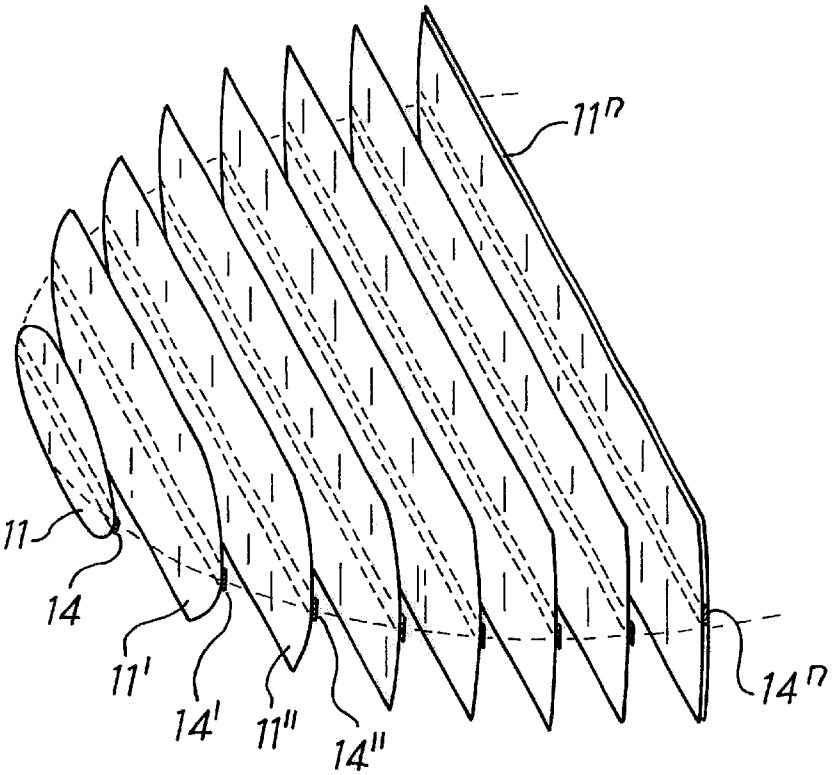

With reference to FIGS. 2 and 2*a,* a preferred embodiment of the shielding members 11, 11', 11" . . . 11*n* is more clearly represented, being completely made of a shape-memory alloy, respectively illustrated in an open condition of the shield, wherein all the members 11, 11', . . . have a planar configuration and are parallel to each other in a direction perpendicular to the cross-section area of passage between the two pumps GP and TMP of FIG. 1. Each member is fixed to a metal strap 14, 14', 14", . . . 14$^n$ by mechanical fastening means such as screws and bolts or by welding spots. These straps, made of a metal without shape memory, such as steel, form the support of the shielding members and the axes about which they rotate to assume the "closed" or "V"-shape configuration represented in FIG. 2*a*. All the straps 14, . . . are fixed at their ends to the support flange 13, not shown in FIGS. 2 and 2*a*, but schematically represented in FIG. 2 by a broken bent line that shows schematically its trace. The two central and parallel broken lines for each member 11 not only represent the trace of the support strap, but also the two lines along which the members are invited to fold during the change of shape, as is better seen in FIG. 2*a* showing the shielding members in their V-shape, already schematically represented in FIG. 1, up to the pair of central members which extend along the full inner diameter of flange 13 with the V opening directed to opposite sides, being mounted on the same support strap 14$^n$. In such a configuration the optical path between getter pump GP and TMP pump is completely obstructed.

Figure 3A:
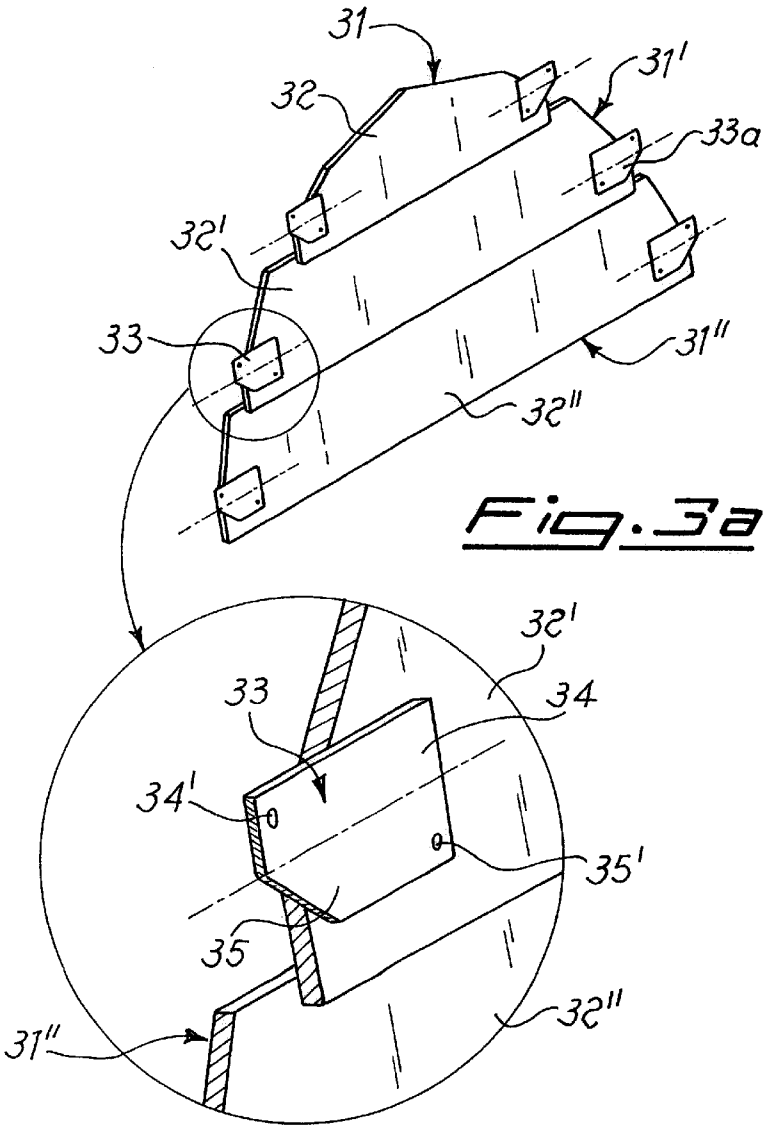
FIGS. 3 and 3*a* show, still in a perspective partial view, only three shielding members of the device according to the present invention in an alternative embodiment, respectively in an open and closed position, in both cases with an enlarged detail.
Figure 3:
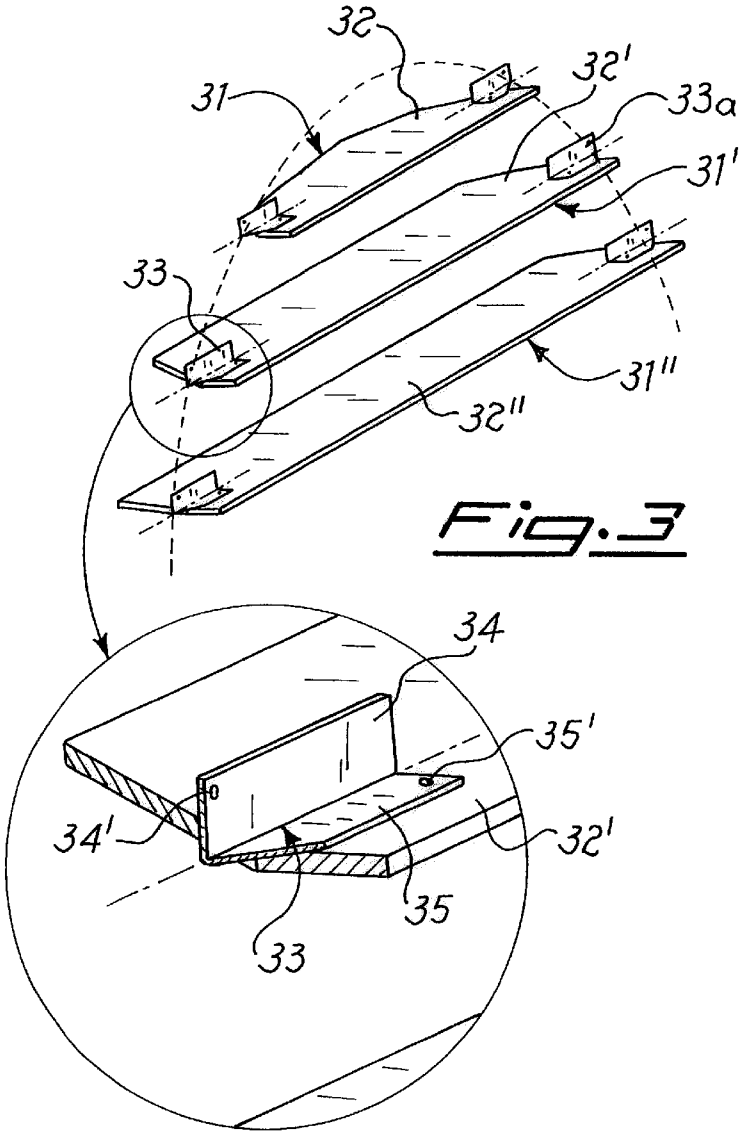

An alternative embodiment of shielding members for a device according to the present invention is shown, in the two configurations of opening and closure, respectively in FIGS. 3 and 3*a*. In this case the shielding members 31, 31', 31" are not wholly made of shape-memory material, but are formed of a metal strip 32, 32', 32", . . . each end of which is integral to an element made of a shape-memory alloy (33, 33*a*). Each element 33, 33*a* is suitable to be folded, according to the temperature, as previously stated, along a central axis represented as a dash-and-dot line. Such a central folding line defines in each member 33, 33*a* two portions 34, 35, the first of which is fixed to the flange 13 (not even here shown, but schematically represented through its trace by means of an elliptical broken line) for example through a welding spot or a fastening means 34'. The other portion 35 of each member 33, 33*a* is fixed to the strip 32, 32', . . . of the corresponding shielding member 31, 31', . . . again by means of a welding spot or fastening element 35'. As a consequence, when the elements 33, 33*a* change their configuration from that substantially L-shaped of FIG. 3 to the substantially planar one of FIG. 3*a* on account of a temperature increase, there is obtained the consequent contemporary rotation of all the shielding members which thus assume the closed configuration of FIG. 3*a* with the members co-planar to each other having their edges overlapping in order to completely shield the passage between the two pumps. The strips 32, 32', . . . are preferably made of steel. It should be noted that in this case the angular configuration of the shape-memory elements corresponds to the situation of shield open, and thereby a temperature lower than that at which they show a planar configuration and the shield is substantially closed, contrary to what happened with the embodiment of the previous figures.

We claim:

1. A mobile shielding device (10), mounted on a vacuum flange (13) connecting in line a non-evaporable getter pump (GP) and a turbo pump (TMP), characterized by comprising a plurality of shielding metal members (11, 11', . . . ; 31, 31', . . . ) capable of automatically modifying their shape or orientation according to the temperature of the device itself, between two different configurations, in one first of which the shielding members are substantially co-planar and form a substantially continuous shield between the two pumps, whereas in the second configuration said members (11, 11', . . . ; 31, 31', . . . ) provide the lowest possible hindrance in the cross-section area of passage between the two pumps, ensuring the highest conductance, said shielding members comprising elements of a shape-memory material, of known type, which are responsive to the temperature for passing from a first shape, corresponding to a higher temperature in a range of working temperatures of the shape-memory material, associated with the said first configuration of the shielding members, to a second shape corresponding to a lower temperature in the same range of temperatures, being associated with the second configuration of the shielding members.

2. A shielding device according to claim 1, characterized in that said shielding metal members (11, 11', . . . 11$^n$) are essentially formed of said shape-memory material.

3. A shielding device according to claim 2, wherein said shape-memory material is made of a Ni—Ti alloy.

4. A device according to claim 3, wherein said Ni—Ti alloy has a composition comprising between 54 and 56% by weight Ni, balance Ti.

5. A device according to claim 4, wherein said Ni—Ti alloy has a composition comprising between 55.1 and 55.5% by weight Ni, balance Ti.

6. A device according to claim 2, wherein said shape-memory material is a Cu—Al—Zn alloy.

7. A device according to claim 6, wherein said Cu—Al—Zn alloy comprises, by weight, between about 70 and 77% copper, between about 5 and 8% aluminum and between about 15 and 25% zinc.

8. A device according to claim 2, characterized in that said shielding members (11, 11', . . . ) are arranged side by side and parallel to a diameter of said flange (13), to which each of them is connected at the ends of a central strap (14, 14', . . . ) of a metal not of the shape-memory type, the mutual distance between said straps (14, 14', . . . ), corresponding to the distance between said shielding members (11, 11', . . . ) in open position, being less than the half width of said members, whereby whichever two of them, contiguous to each other, are substantially overlapping in said first configuration of closure.

9. A device according to claim 8, wherein said shielding members (11, 11', . . . ) assume a V-shape in said second closure configuration.

10. A shielding device according to claim 1, wherein said shielding members (31, 31', . . . ) are formed as metal blades (32, 32', . . . ), each of which is associated, at least at one end, to an element (33, 33', . . . ; 33*a*, 33'*a* . . . ) of the shape-memory type.

11. A device according to claim 10, wherein said shape-memory element is made of a Ni—Ti alloy.

12. A device according to claim 11, wherein said Ni—Ti alloy has a composition comprising between 54 and 56% by weight Ni, balance Ti.

13. A device according to claim 12, wherein said Ni—Ti alloy has a composition comprising between 55.1 and 55.5 by weight Ni, balance Ti.

14. A device according to claim 10, wherein said shape-memory material is a Cu—Al—Zn alloy.

15. A device according to claim 14, wherein said Cu—Al—Z alloy comprises, by weight, between about 70 and 77% copper, between about 5 and 8% aluminum and between about 15 and 25% zinc.

16. A device according to claim 10, wherein said metal blades (32, 32', . . . ) are all arranged parallel to each other and to a diameter of said flange (13) to which they are connected at least at an end by means of a first portion (34) of said shape-memory elements (33, . . . ; 33*a,* . . . ).

17. A device according to claim 16, wherein said shape-memory element (33 . . . ; 33*a,* . . . ) comprises, in addition to said portion (34) of connection to the flange (13), a second portion (35) substantially equal to the first one, by means of which it is connected to the corresponding blade (32, 32', . . . ).

18. A device according to claim 17, wherein the distance between to any contiguous shielding members (31, 31', . . . ) is less than the half width of the same members, whereby in said first closure configuration of the shape-memory elements (33, 33', . . . ) the corresponding metal blades (32, 32', . . . ) in the closure position are partially overlapping to each other, at least in the edge area.

* * * * *